US005738010A

United States Patent [19]

Greive

[11] Patent Number: 5,738,010

[45] Date of Patent: Apr. 14, 1998

[54] PRINTING PRESS AND METHOD OF CONVEYING SHEETS ALONG MULTIPLE FORM CYLINDERS

[75] Inventor: Martin Greive, Heidelberg, Germany

[73] Assignee: Heidelberger Druckmaschinen AG, Heidelberg, Germany

[21] Appl. No.: 722,369

[22] Filed: Sep. 27, 1996

[30] Foreign Application Priority Data

Sep. 29, 1995 [DE] Germany ..... 195 36 359.0

[51] Int. Cl.[6] ..... B41T 13/24

[52] U.S. Cl. ..... 101/232; 101/485

[58] Field of Search ..... 101/232, 233, 101/231, 234, 240, 242, 216, 217, 212, 483, 484, 485

[56] References Cited

U.S. PATENT DOCUMENTS

| | | | |
|---|---|---|---|
| 3,601,299 | 8/1971 | Utzendorf | 101/232 |
| 3,934,505 | 1/1976 | Kushner | 101/485 |
| 4,116,127 | 9/1978 | McInerny | 101/232 |
| 4,263,845 | 4/1981 | Okamura | 101/485 |
| 4,620,807 | 11/1986 | Polit | 101/232 |

FOREIGN PATENT DOCUMENTS 1 099 560 3/1958 Germany .

*Primary Examiner*—Christopher A. Bennett

*Attorney, Agent, or Firm*—Herbert L. Lerner; Laurence A. Greenberg

[57] ABSTRACT

A method for creating contact pressure forces between printing substrates conveyed on an endless conveyor belt and multiple ink transfer devices arranged at a distance from one another in tandem along the conveyor belt, the ink transfer devices having respective cylindrically curved surfaces located opposite the conveyor belt. The method includes creating the contact pressure forces through the use of a prestress applied to the conveyor belt, and partially looping the substrates on the curved surfaces of the ink transfer devices with said conveyor belt.

8 Claims, 5 Drawing Sheets

PRINTING PRESS AND METHOD OF CONVEYING SHEETS ALONG MULTIPLE FORM CYLINDERS

BACKGROUND OF THE INVENTION

Field of the Invention

The invention relates to a printing press comprising an endless conveyor belt and to a method of creating a contact pressure in the transport of sheets along multiple form cylinders through the use of a conveyor belt.

From the brochure "RICOH NC 8015" of the Ricoh company is known a color printer including an endless conveyor belt, whereon substrates to be printed, such as paper sheets, are conveyed along multiple ink transfer devices arranged in tandem at a distance from one another along the conveyor belt, each having a cylindrical surface located opposite the conveyor belt.

When such type of sheet transport is used in a printing press, an exact amount of contact pressure has to be created between the form cylinder and the paper. For this purpose, a rigid or elastic impression cylinder or a plane and rigid contact surface may be used, similar to what is used in conventional printing presses, whereby the conveyor belt with the sheets conveyed thereon passes through between a form cylinder and the contact pressure through the use of in each printing unit. However, this configuration requires the adjustment of each printing unit individually, when sheets of different thickness are to be printed or when the contact pressure needs to be changed for other reasons.

SUMMARY OF THE INVENTION

It is accordingly an object of the invention to provide a printing press and a method of conveying sheets along multiple form cylinders, which overcome the hereinaforementioned disadvantages of the heretofore-known devices and methods of this general type and which reduce adjustment operations required for adjustment of multiple printing units when operating conditions are changed.

Due to the partial looping of the substrate around the curved surface of the ink transfer devices caused by the prestressed conveyor belt, a contact pressure is created perpendicularly to each ink transfer device, said contact pressure depending on the prestress force of the conveyor belt. Each ink transfer device can be a form cylinder of a printing unit or a belt supplying ink from another location in the printing unit and revolving around a cylinder on which the ink is transferred to the substrates through pressure.

In order to simultaneously increase or decrease the contact pressure forces in all printing units, only the prestress value of the conveyor belt needs to be changed. This also applies when for print-technical reasons it is necessary to achieve different contact pressure forces in the various printing units. In this case the distribution of the contact pressure forces to the printing units will be preset by adjusting the individual ink transfer devices in the direction of the conveyor belt and away from it in accordance with the desired contact pressure, and subsequently only the prestress value is changed when, for example, the paper thickness changes.

The invention is particularly suited for digital printing presses, wherein the back pressure required for a perfect print and the forces of separation from the form cylinder are substantially lower or weaker than in conventional printing presses. The prestress for producing such a back pressure can simply be created in that the conveyor belt is kept stressed within its range of elasticity. The intensity of the contact pressure forces can be controlled through the prestress of the conveyor belt as well as through the modulus of elasticity of the conveyor belt.

The required low back pressure in digital printing presses can be created without problems already at small looping angles. Therefore, such printing presses allow for a longitudinal arrangement, whereby the conveyor belt revolves around two rollers mounted at a distance from one another and multiple printing units are arranged in tandem along a section of the conveyor belt, without that section being excessively deflected.

Excessively large looping angles, i.e. looping angles considerably larger than 90°, would be unsuitable, not only in view of construction, as other important components of the printing units have to be arranged on the circumference of the form cylinder, but also for the reason that the surface pressure, i. e. the rate of force relative to the surface, with which the paper coming from the conveyor belt is pressed onto the form cylinder, becomes lower towards larger looping angles. In such a case ink transfer would take place with irregular force, and the separation of the sheets from the form cylinder would be more difficult to accomplish.

On the other hand, with suitably selected looping angles the internal tension of the sheet is utilized better than with a straight sheet guidance, in order to separate the sheet from the form cylinder after printing.

The looping of the sheet on the form cylinder also results in an improved sheet transport, as the forces of adhesion are greater and slippage decreases.

When a sheet enters the nip in the cylinder, the conveyor belt is lifted somewhat from the form cylinder, however, the required change in length of the belt only amounts to a few micrometers. The accompanying shock is absorbed by the flexible conveyor belt and causes only slight vibrations.

Since impression cylinders or the like are eliminated and instead, there only needs to be provided a device for creating the prestress, for example, an adjustment device for a roller around which the conveyor belt revolves, the printing press according to the invention is of very simple construction and can therefore be manufactured at low cost.

With the foregoing and other objects in view there is provided, in accordance with the invention, a method for creating contact pressure forces between printing substrates conveyed on an endless conveyor belt and multiple ink transfer devices arranged at a distance from one another in tandem along the conveyor belt, the ink transfer devices having respective cylindrically curved surfaces located opposite the conveyor belt, such that contact pressure forces are created through a prestress of the conveyor belt and through partial looping of the substrates on the curved surfaces of the ink transfer devices by the conveyor belt.

According to a further mode of the invention, the contact pressure forces are commonly set through the use of the prestress set on the conveyor belt.

According to another mode, the contact pressure force at an individual ink transfer device is set by adjusting the ink transfer device in the direction of the conveyor belt or away from it.

With the objects of the invention in view there is also provided a printing press, comprising an endless conveyor belt for printing substrates and multiple ink transfer devices arranged at a distance from one another in tandem along the conveyor belt, the ink transfer devices having respective cylindrically curved surfaces located opposite the conveyor belt, and wherein during the operating state of the printing press the conveyor belt is Under a prestress and the ink transfer devices are arranged such, that at each ink transfer device the planes of the arriving sections and the leaving section of the conveyor belt intersect one another at an angle, whereby the substrates on the curved surfaces of the ink transfer devices are looped by the conveyor belt.

According to still another feature, each ink transfer device is a form cylinder or a belt revolving around a respective cylinder of a printing unit.

According to a still further feature, the conveyor belt revolves around multiple rollers of which at least one is adjustable for setting the belt tension.

According to still another feature, the conveyor belt revolves around two rollers mounted at a distance from one another, and the prestress and the elasticity of the conveyor belt are chosen such that contact pressure forces can be set within a desired range, without the two sections of the conveyor belt touching one another.

According to again another feature, each ink transfer device, for setting the respective contact pressure force is individually adjustable in direction of the conveyor belt and/or away from it.

According to a concomitant feature, the printing press is a digital printing press.

Although the invention is illustrated and described herein as embodied in a printing press and a method of conveying sheets along multiple form cylinders, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
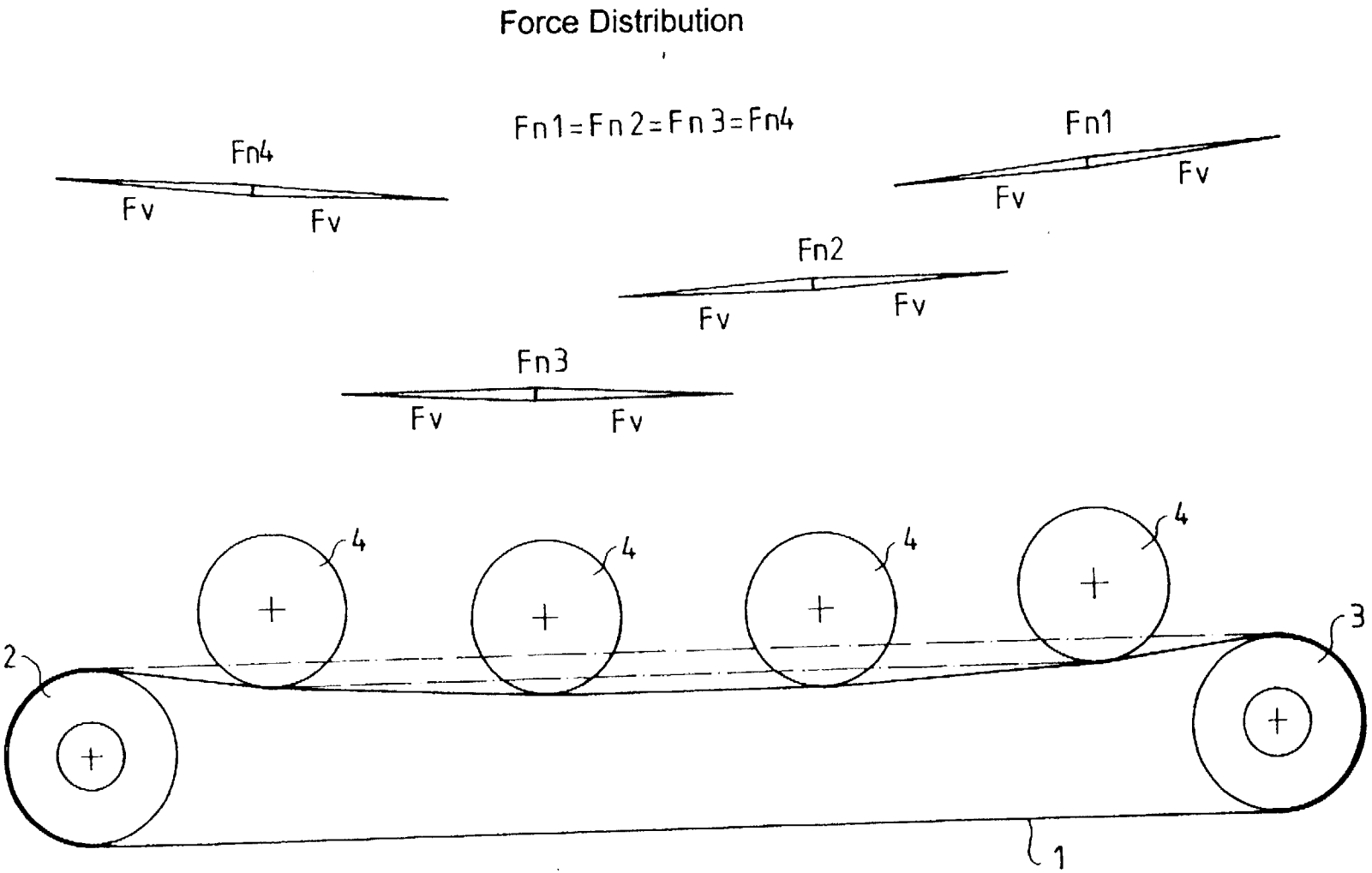
FIG. 1 is a basic illustration of a printing press comprising a conveyor belt and multiple printing units arranged in tandem, wherein a back pressure is created through prestress of the conveyor belt.

Referring now to the figures of the drawings in detail and first, particularly, to FIG. 5 thereof, there is seen a printing press which will be described first, in order to explain a conventional method for creating contact pressure forces. This printing press comprises an endless conveyor belt 1 which revolves around two rollers 2 and 3 mounted at a distance from one another and conveys sheets (not shown) on its upper section in similar manner as mentioned above in connection with the color printer. Above the upper section of the conveyor belt 1, between the rollers 2 and 3, four printing units are arranged in tandem at equal distance from one another, only the form cylinders 4 being shown. Below the upper section of the conveyor belt 1 four impression cylinders 5 are mounted, each impression cylinder 5 being located opposite a form cylinder 4.

The conveyor belt 1 moves in a straight line through between the form cylinders 4 and the impression cylinders 5, whereby between a respective form cylinder 4 and an impression cylinder 5 a contact pressure force Fn is acting perpendicularly to the surface of the form cylinder 4 through the use of which the sheets conveyed on the conveyor belt 1 are pressed against the form cylinder 4, in order to successively transfer printing inks from the form cylinders 4 onto the sheets. The form cylinders 4 as well as the impression cylinders 5 are individually adjustable in height, in order to be adapted to various thickness of paper.

Figure 5:
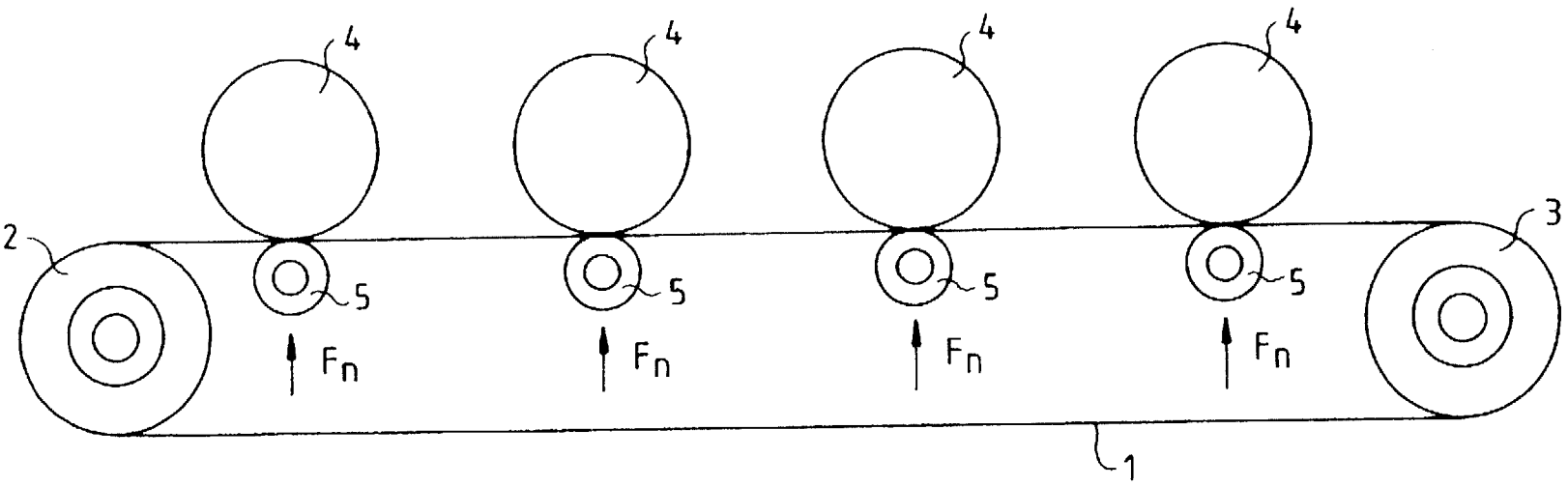
FIG. 5 is a basic illustration of a printing press with a conveyor belt and multiple printing units arranged in tandem wherein back pressure is created through impression cylinders.

Referring now to FIG. 1, wherein elements identical with elements in FIG. 5 are designated by the same reference numerals.

The printing press shown in FIG. 1 is different from the one shown in FIG. 5 in that it has no impression cylinders. Instead, the form cylinders 4 are arranged in a way that the places on the circumference of the form cylinders 4 butting against the conveyor belt 1 are located more or less far below a plane which would be in line with a straight path of the upper section of the conveyor belt 1. In other words, the form cylinders 4 are arranged such that the upper section of the conveyor belt 1, seen as a whole, nearly parabolically deflects towards the lower section. However, between respectively two form cylinders 4 the conveyor belt 1 extends in a straight line, thereby at each form cylinder 4 the planes of the arriving part and the leaving part of the conveyor belt 1 cut one another at a small angle. In this condition the conveyor belt 1 is subjected to a prestress force Fv.

Each form cylinder 4 is looped by the conveyor belt 1 around a small part of its circumference, the looping angle being equal to the angle at which the planes of the arriving part and the leaving part of the conveyor belt 1 cut one another at each form cylinder 4. Thereby, a contact pressure force Fn is exerted perpendicularly to the surface of each form cylinder 4, said contact pressure force Fn depending on the prestress force Fv of the conveyor belt 1, as illustrated in FIG. 1 by four parallelograms of force above the respective associated form cylinder. Due to the parabolic arrangement of the equally spaced form cylinders 4, the four contact pressure forces Fn 1 to Fn4 are equal in value.

One of the rollers 2, 3 is adjustable towards and away from the other through the use of an adjustment device (not shown). When the adjustment device is actuated, the prestress force Fv of the conveyor belt 1 changes, so that in this way the contact pressure forces Fn1 to Fn4 can jointly be increased or decreased. Thereby, the contact pressure forces Fn1 to Fn4 can be changed or adapted simultaneously in all printing units, if this should become necessary during machine operation. Particularly, the printing press can be adjusted very quickly and in simple manner to a new paper thickness or paper quality without having to make any adjustments in the individual printing units, as compared to conventional printing presses.

When a tension-proof conveyor belt 1 with a high modulus of elasticity is used, for example a conveyor belt consisting of steel or having steel inserts, a large adjustment range can be achieved, although the path of adjustment for the rollers 2, 3 is very short, so that the effective length of the conveyor belt 1 changes only slightly with an adjustment of the prestress. The prestress can only be applied to the conveyor belt 1 through its internal tension while the rollers 2, 3 are arrested; possibly there may also be provided, for example, an elastic suspension of one of the rollers 2, 3.

In a further exemplary embodiment of the present invention each form cylinder 4 is individually adjustable in the direction of the conveyor belt 1 and away from it, in order to carry out certain basic adjustments. This is being explained with reference to FIG. 2 and FIG. 3 which differ from FIG. 1 only with regard to the positions of the form cylinders 4.

Figure 2:
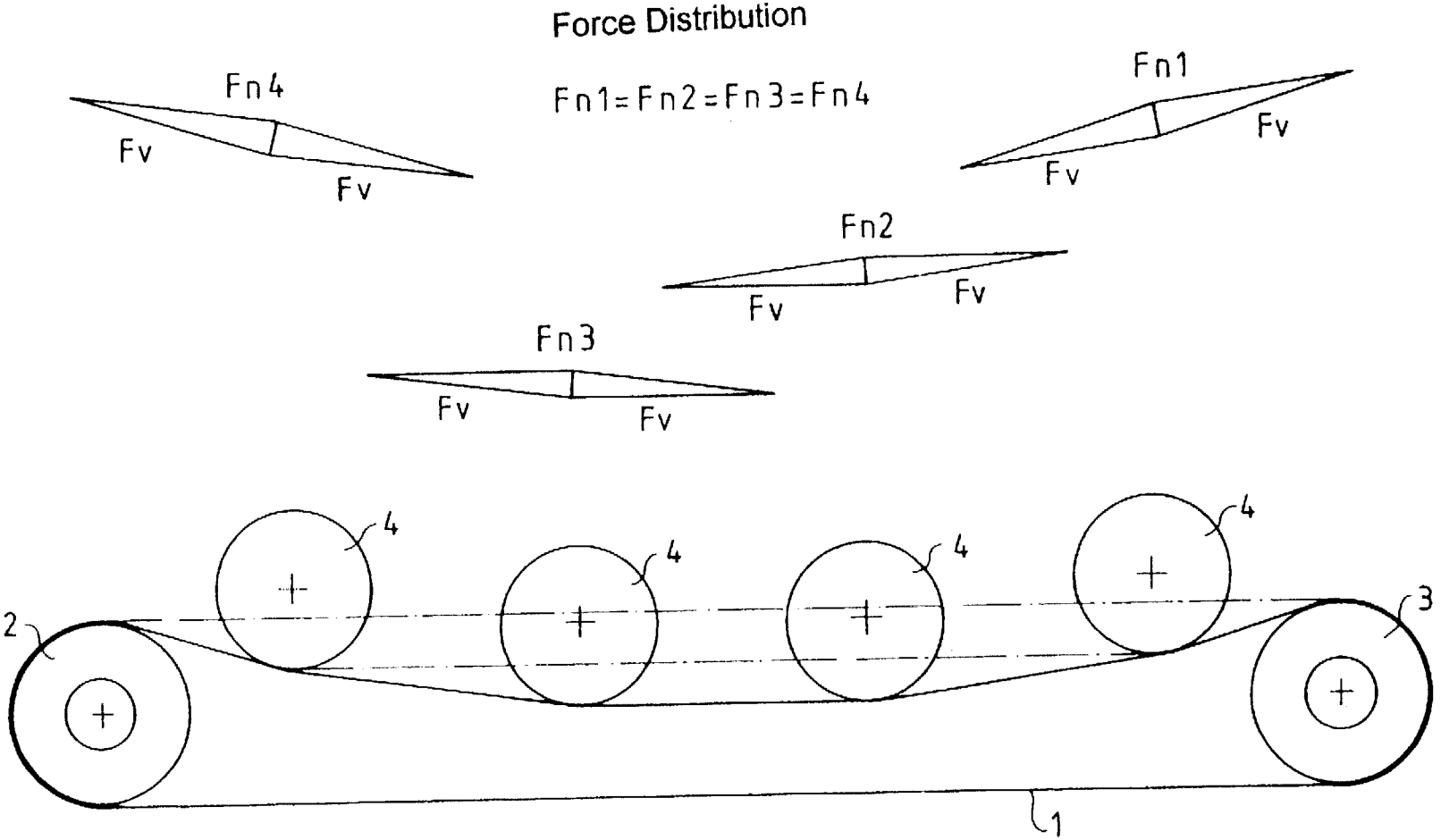
FIGS. 2 and FIG. 3 show force distribution of the printing press of FIG. 1 with changed adjustment conditions.

In FIG. 2 all form cylinders 4 are adjusted to a lower position with respect to the rollers 2, 3 than in FIG. 1. The same prestress force Fv as in FIG. 1 is created, for example, through a suitable decrease in distance between the rollers 2, 3. However, due to the larger looping angle greater contact pressure forces Fn1 to Fn4 are created which are of equal value and can be commonly increased or decreased through a change of the prestress force Fv, as described in connection with FIG. 1. By making a suitable selection of the prestress force Fv and the contact pressure forces Fn1 to Fn4, an optimal looping angle can be set on the form cylinders 4 in the individual case.

Figure 3:
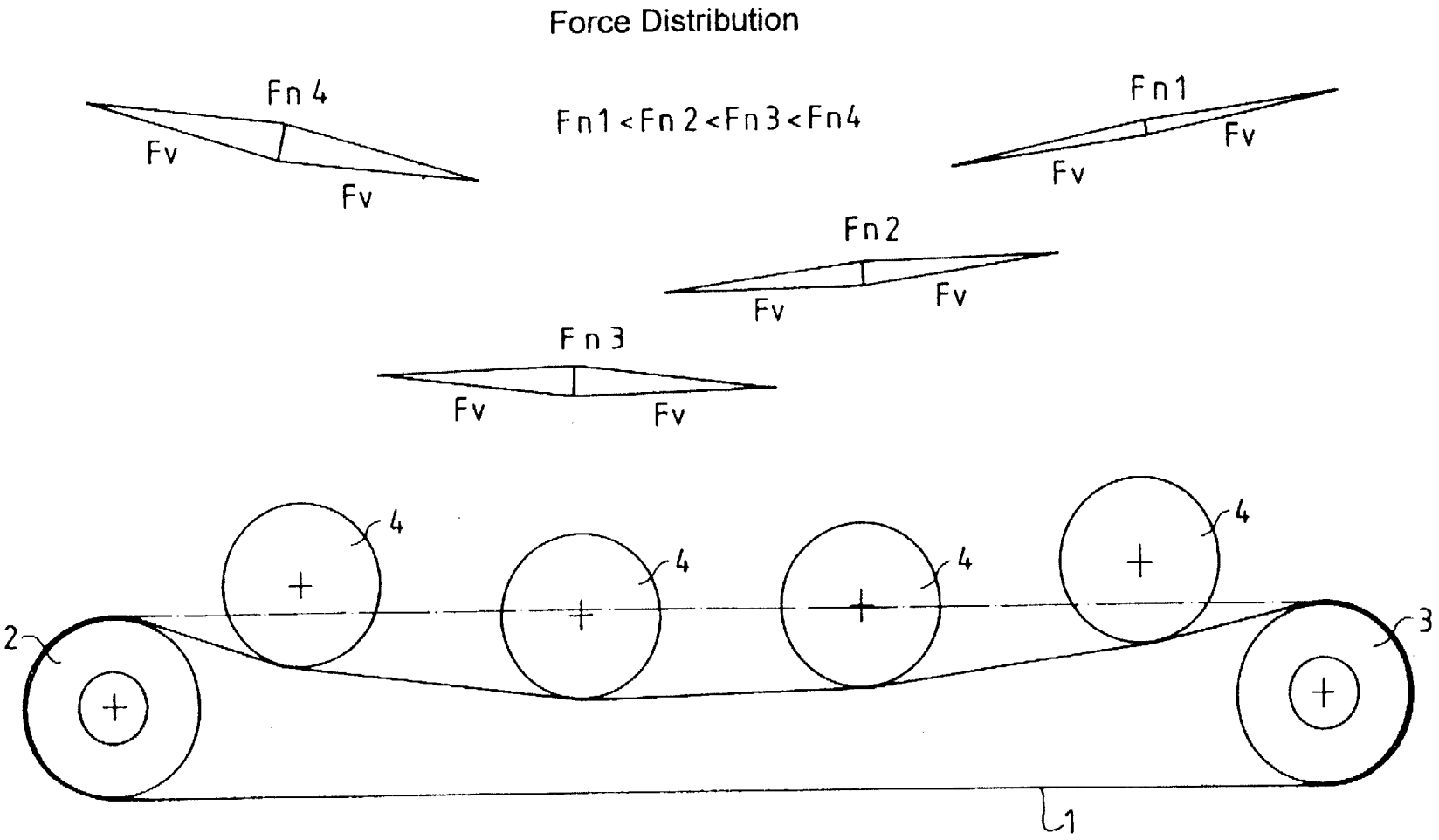

Furthermore, different contact pressure forces Fn1 to Fn4 may be set through suitable positioning of the individual form cylinders 4. This is advantageous, for example, when either more contact pressure force or less contact pressure force is required for the printing of a further color over an already printed color. For example, the form cylinders 4 can be set in a manner that the contact pressure forces Fn1 to Fn4 become lower or weaker in the course of printing, as illustrated in FIG. 3. These contact pressure forces, too, can then be commonly increased or decreased by setting the prestress force Fv.

The invention is not limited to a more or less straight-lined arrangement of the form cylinders. As shown in the basic illustration of FIG. 4, there may be arranged, for example, four form cylinders 6 behind one another in spaced relation along a circular arc, the angle of the circular arc being somewhat more than 180° in this illustration. In front of the first and behind the last form cylinder 6 in this arrangement there is respectively placed a guide roller 7, 8 in a manner that an endless conveyor belt 9 guided around the guide rollers 7, 8 partially loops all four form cylinders 6. The returning section of the conveyor belt 9 is guided around the entire arrangement by two further guide rollers 10, 11 placed at a distance from one another.

Figure 4:
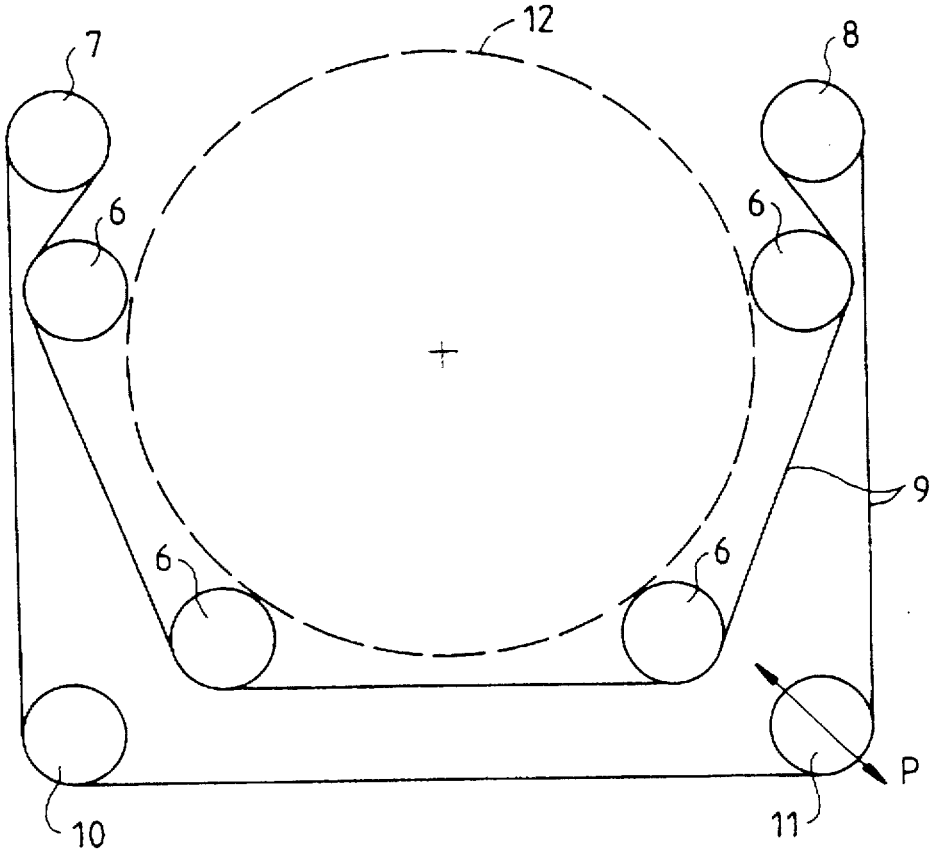
FIG. 4 shows a further embodiment of a printing press with a conveyor belt and multiple printing units, wherein back pressure is created through prestress of the conveyor belt.

One of the guide rollers 7, 8, 10, 11—in FIG. 4 the guide roller 11—is adjustable as indicated by a double arrow P for setting the belt tension. By setting the belt tension the contact pressure forces between the form cylinders 6 and the conveyor belt 9 can be commonly changed, just as in the preceding exemplary embodiments. The circular arrangement of the form cylinders 6 shown in FIG. 4 allows a relatively compact construction and is also feasible for machine constructions having one or multiple elements which are commonly used by all printing units and may be arranged within a circle 12 indicated by a dotted line. In this case it may be necessary for the positions of the form cylinders 6 to be unchangeable; but on the other hand the form cylinders 6 in the exemplary embodiment of FIG. 4 may also be individually adjustable in the direction of the conveyor belt 9 and away from it, in order to set the respective contact pressure forces.

I claim:

1. A method for creating contact pressure forces between printing substrates conveyed on an endless conveyor belt and multiple ink transfer devices spaced from one another in tandem along said conveyor belt, said ink transfer devices having respective cylindrically curved surfaces located opposite said conveyor belt, the method which comprises:

creating the contact pressure forces through the use of a prestress applied to the conveyor belt;

partially looping the substrates on the curved surfaces of the ink transfer devices with said conveyor belt; and commonly setting the contact pressure forces by setting the prestress of the conveyor belt.

2. The method according to claim 1, which further comprises the step of:

setting the contact pressure force at an individual ink transfer device by adjusting the ink transfer device in one of the directions toward the conveyor belt and away from it.

3. A printing press, comprising an endless conveyor belt for printing substrates and multiple ink transfer devices spaced from one another in tandem along the conveyor belt, the ink transfer devices having respective cylindrically curved surfaces located opposite said conveyor belt, and a device for applying prestress to the conveyor belt in the operating state of the printing press, and a device for arranging the planes of the arriving and the leaving sections of the conveyor belt at each ink transfer device to intersect one another at an angle, whereby the substrates on the curved surfaces of the ink transfer devices are looped by the conveyor belt.

4. The printing press according to claim 3, wherein each ink transfer device is a form cylinder, and including a belt revolving around a respective cylinder of a printing unit.

5. The printing unit according to claim 4, including a plurality of rollers about which the conveyor belt is revolving, and a device for adjustably setting the belt tension.

6. The printing press according to claim 4, wherein the conveyor belt revolves around two rollers mounted at a given distance from one another, and a device for selecting prestress and elasticity of the conveyor belt such that contact pressure forces fall within a given range, without two sections of the conveyor belt touching one another.

7. The printing press according to claim 3, including a transferer in each transfer device, each ink transfer device being operative for setting the respective contact pressure force, and a device for individually adjusting the direction of the conveyor belt.

8. The printing press according to claim 3, wherein said printing press is a digital printing press.

* * * * *